US006137391A

United States Patent [19]

Mitamura et al.

[11] Patent Number: 6,137,391

[45] Date of Patent: Oct. 24, 2000

[54] FLUX-CONTROLLED TYPE VARIABLE TRANSFORMER

[75] Inventors: Koichi Mitamura; Mitsuru Maeda; Masaaki Sakamoto, all of Miyagi, Japan

[73] Assignee: Tohoku Electric Power Company, Incorporated, Miyagi, Japan

[21] Appl. No.: 09/254,740

[22] PCT Filed: Dec. 17, 1997

[86] PCT No.: PCT/JP97/04659

§ 371 Date: Jul. 19, 1999

§ 102(e) Date: Jul. 19, 1999

[87] PCT Pub. No.: WO99/31686

PCT Pub. Date: Jun. 24, 1999

[51] Int. Cl.[7] ..... H01F 21/08; H01F 27/24

[52] U.S. Cl. ..... 336/160; 336/214; 336/150; 336/212; 336/215

[58] Field of Search ..... 336/87, 115, 117, 336/212, 214–215, 150, 155, 160

[56] References Cited

U.S. PATENT DOCUMENTS 3,582,829 6/1971 Wanlass ..... 332/117

4,393,157 7/1983 Roberge et al. ..... 323/355

*Primary Examiner*—Michael L. Gellner
*Assistant Examiner*—Anh Mai
*Attorney, Agent, or Firm*—Jordan and Hamburg LLP

[57] ABSTRACT

A flux-controlled variable transformer can control voltage at a high speed without using any voltage adjusting tap. The transformer has a first and second magnetic circuits. The first magnetic circuit is composed of a first and second U-cut cores (13 and 11) which contact at their cut ends with each other in the state either of the two cores has been turned by 90° in a twisting direction relative to the other. The primary winding (14) is wound in common around the second magnetic circuit and the first U-cut core (13) of the first magnetic circuit, the secondary winding (17) is wound around the second magnetic circuit and a control winding (12) is wound on the second U-cut core (11) of the first magnetic circuit. The magnetic flux linking the primary and secondary windings (14 and 17) can be controlled by change of the magnetic resistance in the first magnetic circuit with the primary winding (14) by changing a value of exciting current flowing in the control winding (12). Thus, the voltage in the secondary winding can be continuously changed by adjusting the exciting current flowing in the control winding.

7 Claims, 12 Drawing Sheets

FLUX-CONTROLLED TYPE VARIABLE TRANSFORMER

TECHNICAL FIELD

The present invention relates to static voltage regulators for stabilizing voltage in an electric power system, which are non-tapping voltage-regulators for use in place of transformers having tappings switchable depending upon loads in distribution substations, voltage regulators with taps switchable when being loaded in power transmission systems and pole-mounted transformers for stabilizing secondary voltage.

BACKGROUND ART

Recent development of the national economy has been accompanied with the increasing demand for electric power and the diversity of loads to the electric power. In this connection, there is an increasing need for flexible electrical power utilities that are effectively adaptable to variations of supply voltage. Until now, voltage regulator-transformers provided with tap-changers shown in FIG. 18 has been usually used for stabilizing voltage in the electric power supply systems. The tap-changing type voltage-regulating transformer, however, has intrinsic limitations on its maintenance and service life because it includes a tap-contactor and tap-switching mechanism that cannot avoid mechanical faliure and abrasion of its moving parts causing wearing of parts, poor contact, time-lag of voltage and so on.

In other words, any conventional voltage-regulator-transformer incluing a tap-changer involves a maintenance problem of mechanical wearing of tap-contacts and a tap-switching mechanism and a performance problem of time-delay in voltage control due to slow action of the switching mechanism.

In view of the foregoing, the present invention was made to provide a flux-controlled variable transformer that can control the voltage at a high speed without using a voltage-adjusting tap-changer.

DISCLOSURE OF INVENTION

An object of the present invention is to provide a flux-controlled variable transformer having a continuously variable secondary-winding voltage, which comprises: a first magnetic circuit composed of a first U-cut core and a second U-cut core, both the cores contacting at their cut ends with each other in the state either of the cores having been turned by 90° in twisting direction relative to the other; a second magnetic circuit; a primary winding wound in common around the first U-cut core of the first magnetic circuit and the second magnetic circuit; a secondary winding wound for the second magnetic circuit; and a control winding wound on the second U-cut core of the first magnetic circuit, wherein changing a value of exciting current in the control winding produces a change in magnetic resistance in the first magnetic circuit with the primary winding wound therearound to change the magnetic flux linking the primary and secondary windings, thus resulting in changing the secondary winding voltage in accordance with a change of the current in the control windinng.

Another object of the present invention is to provide a flux-controlled variable transformer having a continuously variable secondary winding voltage, which comprises: a first three-phase magnetic circuit composed of a first three-phase E-cut core and a second three-phase U-cut core, both the cores contacting at their cut ends with each other in the state either of the cores having been turned by 90° in twisting direction relative to the other; a second three-phase magnetic circuit; a primary winding wound in common around the E-cut core of the first three-phase magnetic circuit and the second three-phase magnetic circuit; a secondary winding wound around the second three-phase magnetic circuit; and a control winding wound on the second U-cut core of the first three-phase magnetic core, wherein changing a value of exciting current in the control winding produces a change in magnetic resistance in the first thre-phase magnetic circuit with the primary winding wound therearound to change the magnetic flux linking the primary and secondary windings, thus resulting in changing the secondary winding voltage in accordance with a change of the current in the control windinng.

BEST MODE FOR CARRYING OUT THE INVENTION

Figure 1:
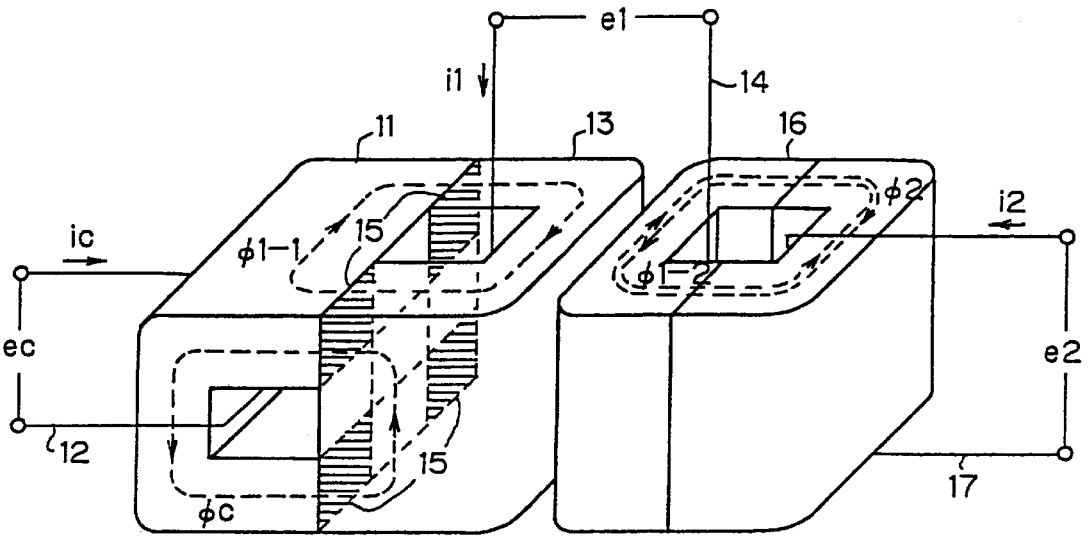
FIG. 1 is a perspective view of a flux-controlled variable transformer according to an embodiment of the present invention.

The present invention is directed to a flux-controlled type variable transformer that controls an induction voltage in the secondary winding by changing an amount of magnetic flux linking the primary and secondary windings.

The basic circuit construction of the transformer of the present invention consists of a first magnetic circuit and a second magnetic circuit, both of which have a common primary winding and the latter of which has a secondary winding. The first magnetic circuit constructed of a first U-cut core and a second U-cut core, which contact at their cut-ends with each other in the state either of the two cores has been turned by 90 degrees in a twisting direction relative to the other. The second U-cut core is provided with a control winding wound thereon.

In a three-phase voltage transformer according to the present invention, a primary winding is commonly wound around first and second three-phase magnetic circuits and a secondary winding is wound around the second magnetic circuit. The first three-phase magnetic circuit is constructed of a first three-phase U-cut core and a second U-cut core, which are in contact with each other at their cut-ends in the state either of the two cut cores has been turned by 90 degrees in a twisting direction relative to the other. The second U-cut core is provided with a control winding wound thereon.

A control power source is constructed by winding an auxiliary winding on the first U-cut core of the first magnetic circuit of the flux-controlled variable transformer (or the first three-phase E-cut core of the first magnetic circuit of the three-phase flux-controlled variable transformer) and connecting the auxiliary winding to a rectifier circuit provided with a voltage control circuit or a voltage control circuit plus a voltage-waveform control circuit. The auxiliary winding is a reactor or a variable reactor to suppress distortion of voltage induced in the secondary winding.

In the transformer circuit construction, voltage (e1) applied to the primary winding produces a magnetic flux (ϕ1-1) in the first magnetic circuit and a magnetic flux (ϕ1-2) in the second magnetic circuit. At the same time, exciting current (i1) flows in the primary winding for producing the magnetic flux (ϕ1-1) in the first magnetic circuit and the magnetic flux (ϕ1-2) in the second magnetic circuit. The voltage induced in the secondary winding of the second magnetic circuit results in producing voltage (e2) corresponding to the magnetic flux of the second magnetic circuit. In this condition, secondary (load) current (i2) flows in the secondary winding, producing a magnetic flux (ϕ2) in the second magnetic circuit. The direction of this magnetic flux (ϕ2) is reverse to the direction of the magnetic flux (ϕ1-1) in the primary winding. At the same time, load current follows in the primary winding to cancel that load current. The magnetic flux (ϕ1-2) in the secondary winding decreases, lowering the secondary voltage (e2). The magnetic flux (ϕ1-1) of the first magnetic circuit increases by the amount corresponding to the decrease in the magnetic flux (ϕ1-2) of the second magnetic circuit since the voltage applied to the primary winding and the voltage induced in the secondary winding are balanced with each other.

In this condition, current (ic) flowing in the control winding wound on the second cut-core generates a control magnetic flux (ϕc) with a magnetomotive force (ampere-turn) which is equal to the product of the number-of-turns of control winding through which current (ic) is flowing. This control magnetic flux (ϕc) passes through an area of contact formed between the first and second cut-cores. This contact area serves as a common magnetic path allowing both the magnetic fluxes (ϕ1-1) and (ϕc) to pass therethrough. The magnetic resistance of the common magnetic path increases, reducing the passing of the magnetic flux (ϕ1-1) produced by the voltage applied to the primary winding. The voltage applied to the primary winding and the voltage induced in the secondary winding become balanced with each other by increasing the magnetic flux (ϕ1-2) in the secondary magnetic circuit by an amount corresponding to a decrease in the magnetic flux (ϕ1-1) in the first magnetic flux. The magnetic flux linking the primary and secondary windings wound around the secondary magnetic circuit increases, thus increasing the secondary voltage (e2). The secondary current (i2) decreases due to a decrease in load to the secondary winding, so the reverse magnetic flux (ϕ2) decreases and the primary winding magnetic flux (ϕ1-2) increases in the second magnetic circuit. The magnetic flux linking the primary and secondary windings increases, thus increasing the secondary voltage (e2).

On the contrary, a decrease of the current (ic) in the control winding wound on the second cut-core decreases the magnetomotive force (ampere-turn) being equal to the product of the number-of-turns of the control winding through which the current (ic) is flowing. This reduces the magnetic resistance of the common magnetic path at the contact area between the first and second U-cut cores and, therefore, increases the passing of the magnetic flux (ϕ1-1) produced by the voltage (e1) applied to the primary winding. The voltage (e1) applied to the primary winding and the voltage induced in the secondary winding become to be at balance with each other at a constant magnetic flux according to the voltage (e2) applied to the primary winding. The magnetic flux (ϕ1-2) in the secondary magnetic circuit is reduced by an amount corresponding to the increase of the magnetic flux (ϕ1-1) in the first magnetic circuit. The magnetic flux linking the primary and secondary windings wound around the secondary magnetic circuit decreases, thus lowering the secondary voltage (e2).

The waveform of the magnetic flux (ϕ1-1) of the first magnetic circuit may be distorted due to change of magnetic resistance in the common magnetic path when the control current (ic) flowing in the control winding wound on the second cut-core has a value smaller than a specified value at which the secondary voltage is in a variable range (i.e., the common magnetic path can not be saturated with magnetism). With an input voltage of a sinusoidal waveform, a composite value of the magnetic fluxes (ϕ1-1, ϕ1-2) of the first and second magnetic circuits must have a sinusoidal waveform. However, distortion of the magnetic flux (ϕ1-1) causes distortion of the magnetic flux (ϕ1-2), thus producing higher harmonics in the secondary voltage (e2). Therefore, it is necessary to shape the distorted magnetic flux ϕ1-1 of the primary magnetic circuit to the fundamental sinusoidal components by removing the higher harmonics from the secondary voltage (e2).

Accordingly, the auxiliary winding wound around the first magnetic circuit is connected to the reactor or the variable reactor to shape the magnetic flux (ϕ1-1) of the first magnetic circuit. Current applied to the auxiliary winding produces therein a magnetic flux (ϕ3) which is reverse to the magnetic flux (ϕ1-1) in the first magnetic circuit and acts to reduce magnetic flux density in the latter circuit. The higher harmonic current is suppressed and fundamental waveform current flows in the first magnetic circuit. Current being plenty of fundamental waveform components flows in the primary winding to cancel the magnetic flux (ϕ3) produced by the current in the auxiliary winding. This improves the waveform of the magnetic flux (ϕ1-2) in the second magnetic circuit to remove the higher harmonics therefrom, maintaining the required quality of the electric power.

The auxiliary winding is also provided with the rectifier circuit to supply control current (ic) to the control winding. This circuit can effectively compensate the secondary voltage for fluctuation due to a change in load current. As the secondary current increases, the magnetic flux further moves to the first magnetic circuit. This increases the voltage (e3) induced in the auxiliary winding and the control current (ic) to restrict the transferring magnetic flux. When the secondary current decreases, the control current also decreases. Namely, the control current can be automatically adjusted to compensate the fluctuation of the secondary voltage due to change of the secondary current.

As described above, continuous control of the secondary winding voltage can be realized through controlling magnetic flux linking the primary and secondary windings with a change of the magnetic resistance of the first magnetic circuit of the primary winding by changing a value of the exciting current flowing in the control winding wound on the second U-cut core.

In the three-phase transformer according to the present invention, the three-phase secondary winding voltage can be continuously controlled through control of the three-phase magnetic flux linking the primary and secondary three-phase windings with change of the magnetic resistance of the first three-phase magnetic circuit of the primary winding by changing a value of the exciting current flowing in the control winding wound on the second U-cut core.

Referring to the accompanying drawings, preferred embodiments of the present invention will be described in detail as follows:

FIG. 1 shows a basic construction of a flux-controlled variable transformer embodying the present invention, which includes a first magnetic circuit composed of a first U-cut core 13 and a second U-cut core 11 and a second magnetic circuit composed of a cut-core 16. The first and second magnetic circuits have a common primary winding 14 wound around them and the second magnetic circuit has a secondary winding 17 wound therearound. The first magnetic circuit is constructed of the first and second U-cut cores 13 and 11 that are in contact with each other at their cut-ends in the state either of the two cores has been turned by 90° in a twisting direction relative to the other. The second U-cut core 11 is provided with a control winding 12 wound thereon.

Figure 2:
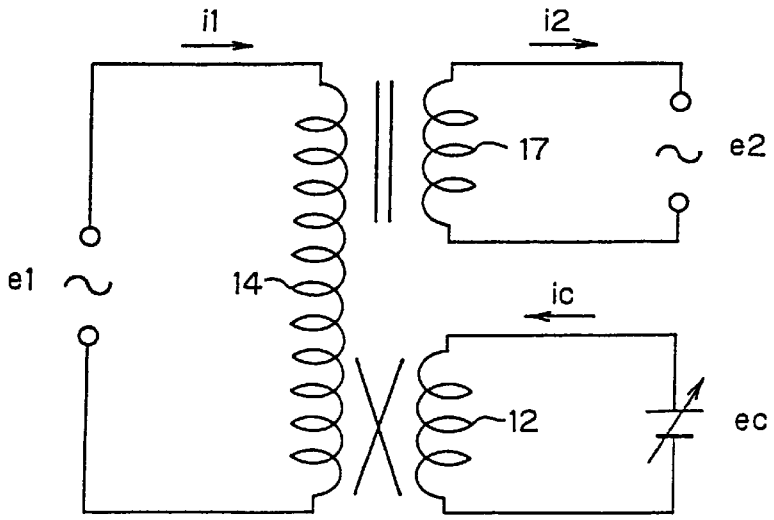
FIG. 2 shows an equivalent circuit of a flux-controlled variable transformer according to the present invention.

FIG. 2 shows an equivalent circuit of the flux-controlled variable transformer of FIG. 1. Symbol X shows that two magnetic cores are in contact with each other at their cut-ends, one core having been turned by 90° relative to the other, and symbol || shows that two cores contacting with each other as are arranged in a row like cores in a conventional transformer.

Figure 3:
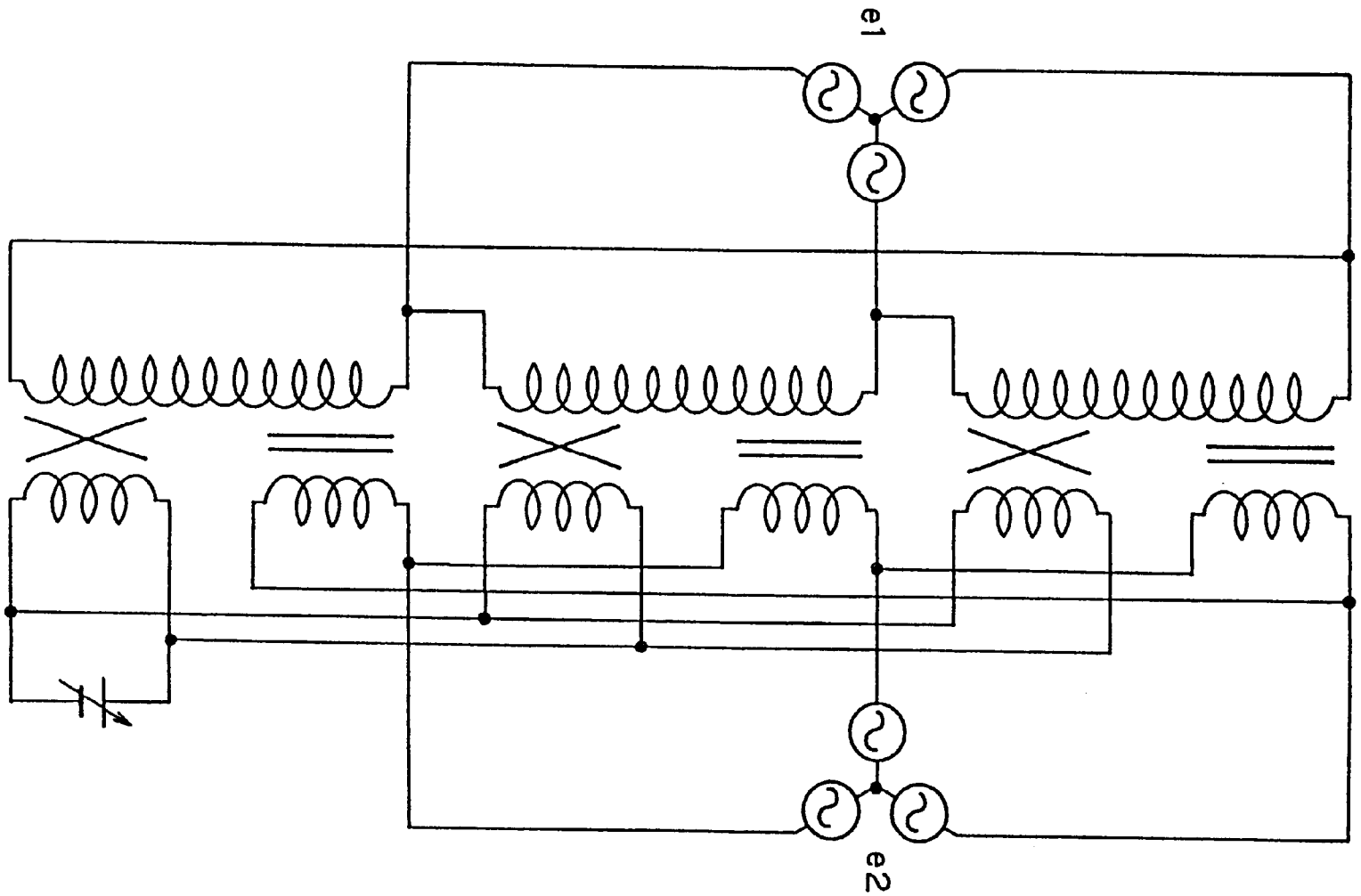
FIG. 3 shows an equivalent circuit of an exemplified three-phase connected flux-controlled variable transformer according to the present invention.

FIG. 3 shows an equivalent circuit of the three-phase-connected flux-controlled variable transformer of FIG. 1.

Figure 4:
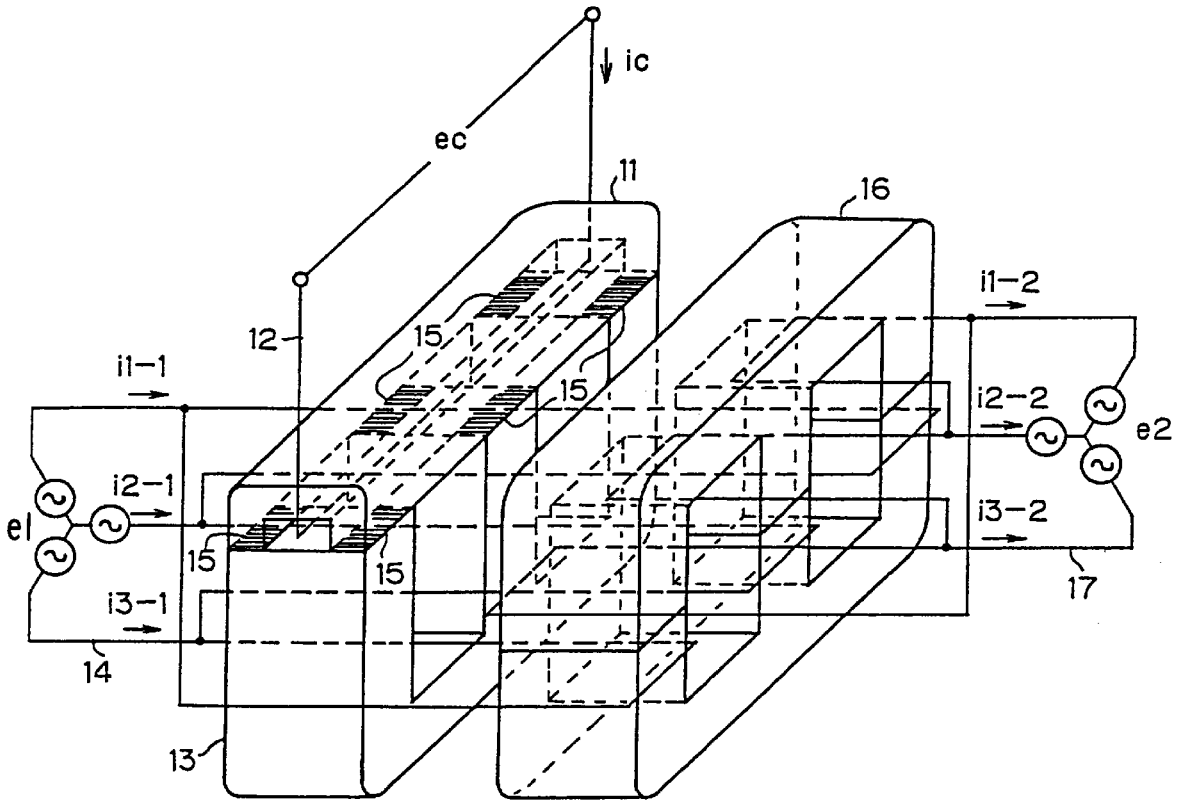
FIG. 4 is a perspective view of a flux-controlled variable transformer that is a three-phase voltage transformer being another embodiment of the present invention.

FIG. 4 shows a basic construction of a three-phase flux-controlled variable transformer embodying the present invention. The construction consists of a first magnetic circuit composed of a first U-cut core 13 and a second U-cut core 11 and a second magnetic circuit composed of a cut-core 16. The first and second magnetic circuits have a common primary winding 14 wound them and the second magnetic circuit has a secondary winding 17 wound thereon. The first magnetic circuit is constructed of the first and second U-cut cores 13 and 11 that are in contact with each other at their cut-ends as either of the two cores has been turned by 90° in a twisting direction relative to the other. The second U-cut core 11 is provided with a control winding 12 wound thereon.

Figure 5:
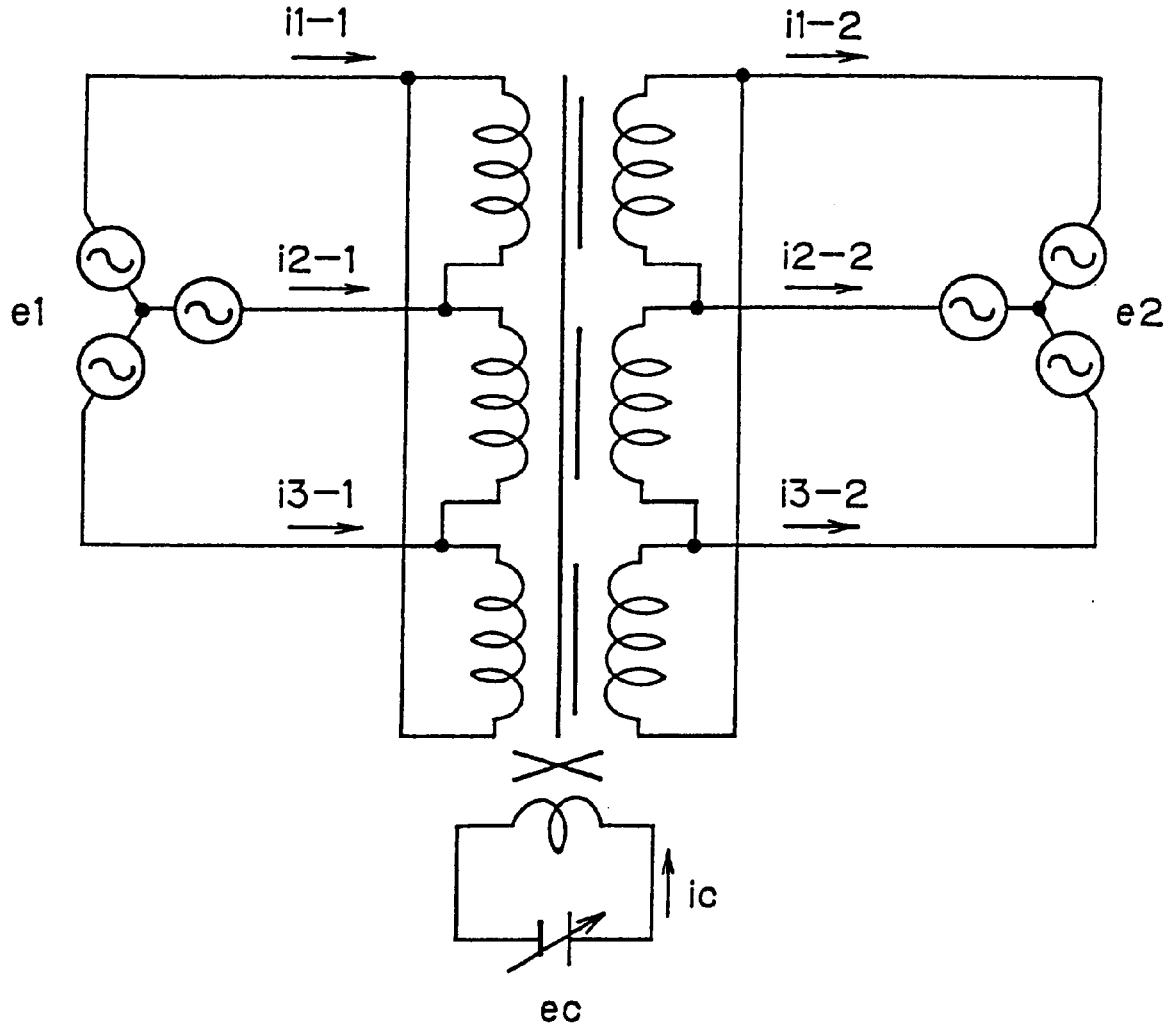
FIG. 5 shows an equivalent circuit of a three-phase flux-controlled variable transformer according to the present invention.

FIG. 5 shows an equivalent circuit of the three-phase flux-controlled variable transformer of FIG. 4.

Referring to FIG. 1, a voltage (e1) is applied to the primary winding 14 to produce a magnetic flux ϕ1-1 in the first magnetic circuit and a magnetic flux ϕ1-2 in the second magnetic circuit. An exciting current (i1) flows in the primary winding 14 for producing the magnetic fluxes (ϕ1-1, ϕ1-2) in the first and second magnetic circuits and a voltage (e2) is induced in the secondary winding 17 wound on the second magnetic circuit, which corresponds to the magnetic flux in the second magnetic circuit.

When current (i2) flows in the secondary winding 17, a magnetic flux (ϕ2) directed reverse to the magnetic flux (ϕ1-2) in the primary winding takes place in the second magnetic circuit and the magnetic flux (ϕ1-2) in the second magnetic circuit is reduced, lowering the secondary voltage (e2). At the same time, the magnetic flux (ϕ1-1) in the first magnetic circuit increases by an amount corresponding to the decrease in the magnetic flux (ϕ1-2) in the second magnetic circuit to make the voltage (e1) of the primary winding 14 be balanced with the induced voltage.

With current (ic) flowing in the control winding 12 wound on the second cut-core 11, the magnetic resistance of the common magnetic-path 15 formed between the first and second U-cut cores increases to reduce the conduction of the magnetic flux (ϕ1-1) therethrough. The primary voltage (e1) applied to the primary winding 14 and the induced voltage are balanced with each other, so the magnetic flux (ϕ1-1) in the first magnetic circuit decreases and the magnetic flux (ϕ1-2) in the second magnetic circuit correspondingly increases. Consequently, the magnetic flux linking primary and secondary windings 14 and 17 wound respectively on the second magnetic circuit increases, thereby the secondary voltage (e2) increases.

The secondary current (i2) increases with increase of the load applied to the secondary winding 17, thereby the magnetic flux (ϕ1-2) in the primary winding of the second magnetic circuit decreases with increase of the inverse magnetic flux (ϕ2). This results in a drop of the secondary voltage (e2). At the same time, the magnetic flux (ϕ1-1) in the first magnetic circuit increases by an amount corresponding to the decrease of the magnetic flux (ϕ1-2) in the second magnetic circuit to make the voltage (e1) of the primary winding 14 be at balance with the induced voltage.

Increasing current (ic) flowing in the control winding 12 wound on the second cut-core 11 increases the magnetic resistance of the common magnetic-path 15 formed between the first and second U-cut cores, thereby reducing the conduction of the magnetic flux (ϕ1-1) therethrough. The primary voltage (e1) applied to the primary winding 14 and the induced voltage are balanced with each other, so the magnetic flux (ϕ1-1) in the first magnetic circuit decreases and the magnetic flux (ϕ1-2) in the second magnetic circuit correspondingly increases. Consequently, the magnetic flux linking the primary and secondary windings 14 and 17 wound on the second magnetic circuit increases, thereby the secondary voltage (e2) increases.

Figure 6:
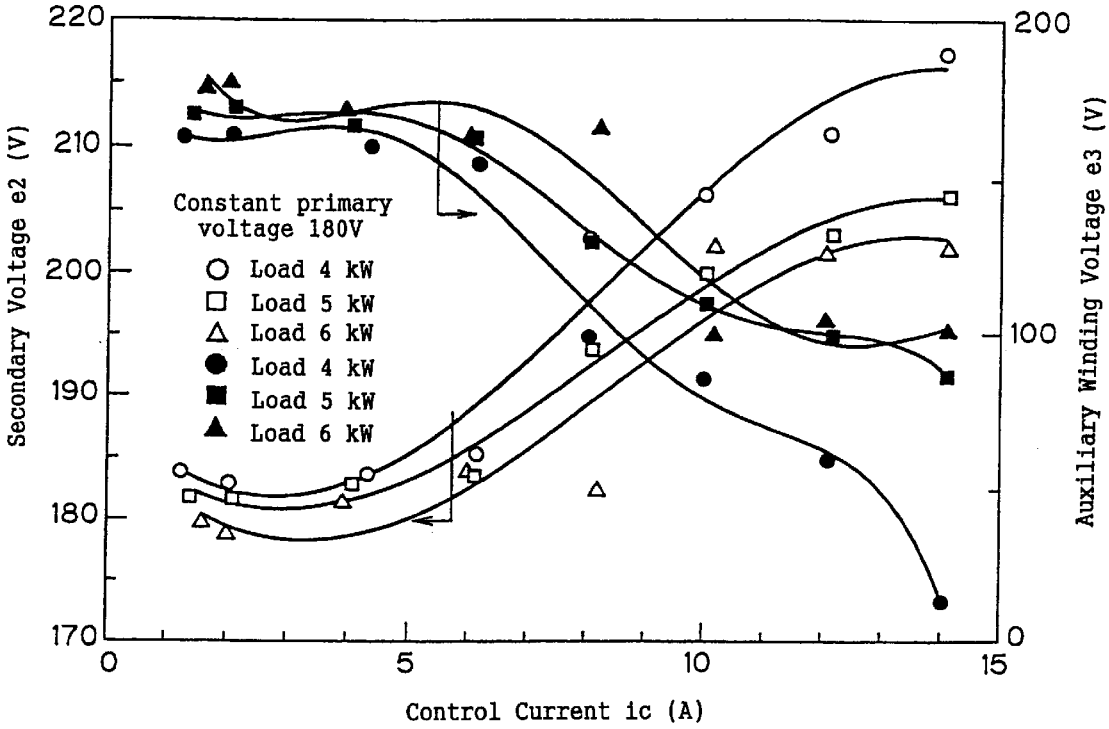
FIG. 6 shows characteristics of a secondary voltage and an additional winding voltage depending on a control current with a load of secondary winding.

The secondary current (i2) decreases with a decrease in the load applied to the secondary winding 17. The inverse magnetic flux (ϕ2) decreases in the second magnetic circuit and, therefore, the magnetic flux (ϕ1-2) in the primary winding 14 increases. This causes the magnetic flux linking the primary and secondary windings 14 and 17 to increase, arising the secondary voltage (e2). In this condition, the control current (ic) in the control winding 12 wound on the second cut-core 11 is reduced to decrease the magnetic resistance of the common magnetic path 15 formed by the contact area of the first and second U-cut cores, allowing the magnetic flux (ϕ1-1) to pass through the common path. The voltage (e1) applied to the primary winding 14 and the induced voltage are balanced with each other and the magnetic flux (ϕ1-1) in the first magnetic circuit increases and the magnetic flux (ϕ1-2) in the second magnetic circuit correspondingly decreases, reducing the magnetic flux linking the primary and secondary windings 14 and 17 wound on the second magnetic circuit. Thus, the secondary voltage (e2) decreases. The relation between the control current (ic) and the secondary voltage (e2) at a constant voltage (e1) applied to the primary winding is shown in FIG. 6.

Figure 7:
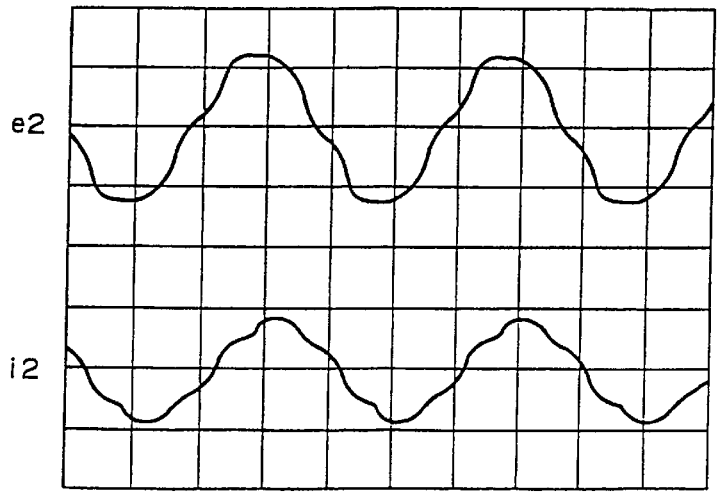
FIG. 7 shows observed distortion of a secondary voltage waveform depending on a control current.

A variable instantaneous value of the control current (ic) flowing in the control winding wound on the second cut-core causes a change in magnetic resistance of the common magnetic path. Therefore, the waveform of the secondary voltage (e2) may be disturbed as shown in FIG. 7 when a value of the control current (ic) is smaller than that at which the secondary voltage (e2) is in a variable range. At the same time, the magnetic flux (ϕ1-2) is also distorted and the secondary voltage (e2) may include a higher harmonic produced.

Figure 8:
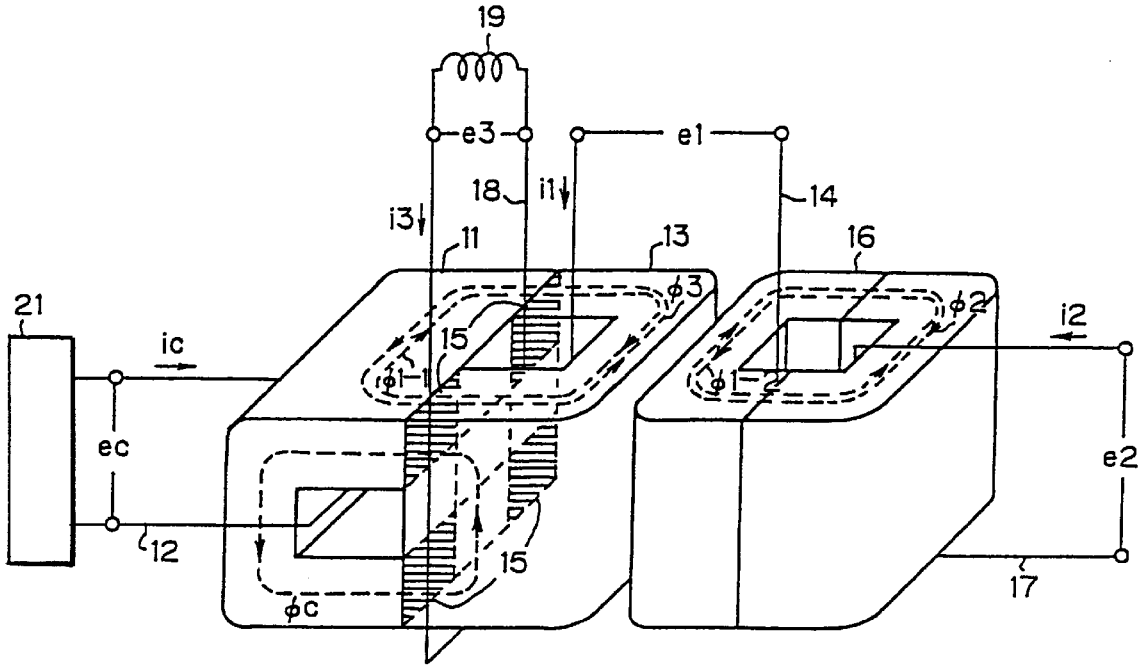
FIG. 8 is a perspective view of a flux-controlled variable transformer that can eliminate harmonics from a secondary voltage, which is another embodiment of the present invention.

FIG. 8 is a perspective view of a flux-controlled variable transformer capable of removing higher harmonics from its secondary voltage (e2).

Figure 9:
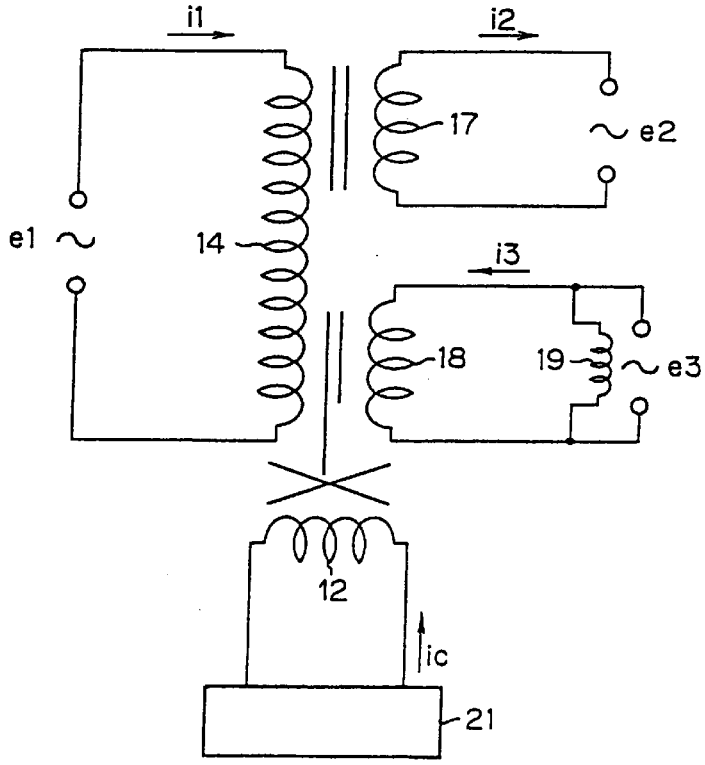
FIG. 9 is an equivalent circuit diagram of the flux-controlled variable transformer of FIG. 8.

FIG. 9 shows an equivalent circuit of the flux-controlled variable transformer of FIG. 8. A reactor 19 is connected to an auxiliary winding 18 wound around a first magnetic circuit to receive a voltage (e3) induced in the auxiliary winding 18 according to the load current (i2) and the control current (ic). A current flow in the reactor 19 causes in the auxiliary winding a magnetic flux (ϕ3) opposite in direction to the magnetic flux (ϕ1-1) of the first magnetic circuit. The magnetic flux density of the first magnetic circuit decreases, suppressing higher harmonics current. The current (i3) in plenty of fundamental waveform components flows therein. Thus, the waveform of the magnetic flux (ϕ1-2) of the second magnetic circuit is improved and higher harmonics are removed from the waveform of the secondary voltage (e2) to maintain the quality of the electric power.

Figure 10:
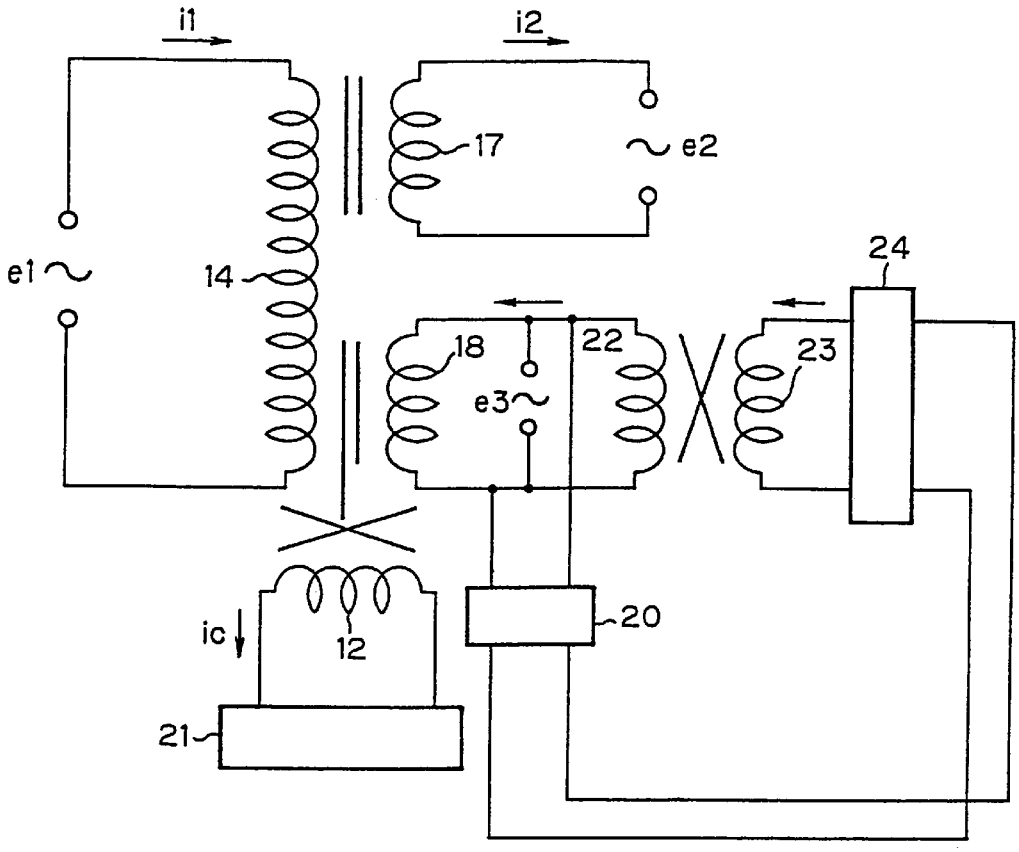
FIG. 10 shows a circuit with a variable reactor with which the reactor shown in FIG. 9 is exchanged.

FIG. 10 is an equivalent circuit of the flux-controlled variable transformer provided with a variable reactor 19 which is connected to an auxiliary winding of the transformer and has variable inductance varying in accordance with adjustment of the secondary voltage. A waveform control circuit is constructed by connecting a main winding 22 of the variable reactor 19 and a rectifier 20 to the auxiliary winding 18. The rectifier 20 serves as a control power source of the waveform control circuit 24. This circuit can adjust the variable reactor at an optimal value by suppressing exciting current to be supplied to the control winding 23 thereof.

Figure 11:
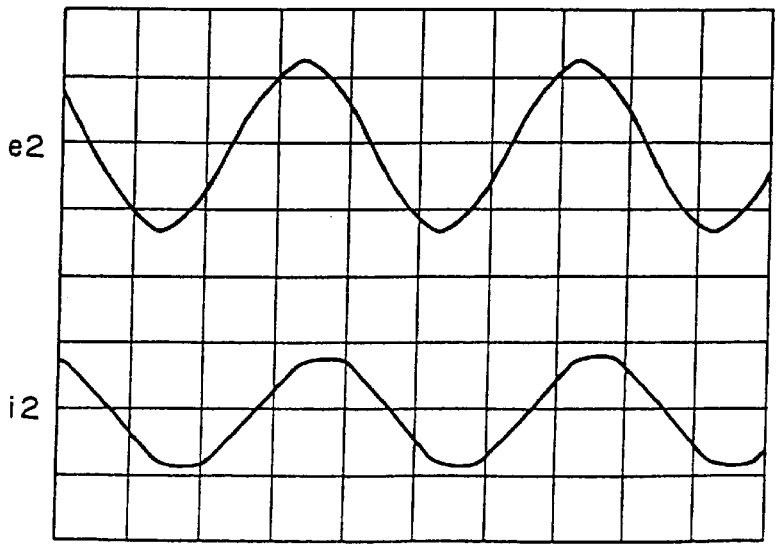
FIG. 11 shows observed waveforms of a secondary voltage and current.

FIG. 11 is an oscillogram showing an improved waveform of the secondary voltage by the effect of the connected reactor 19.

Figure 12:
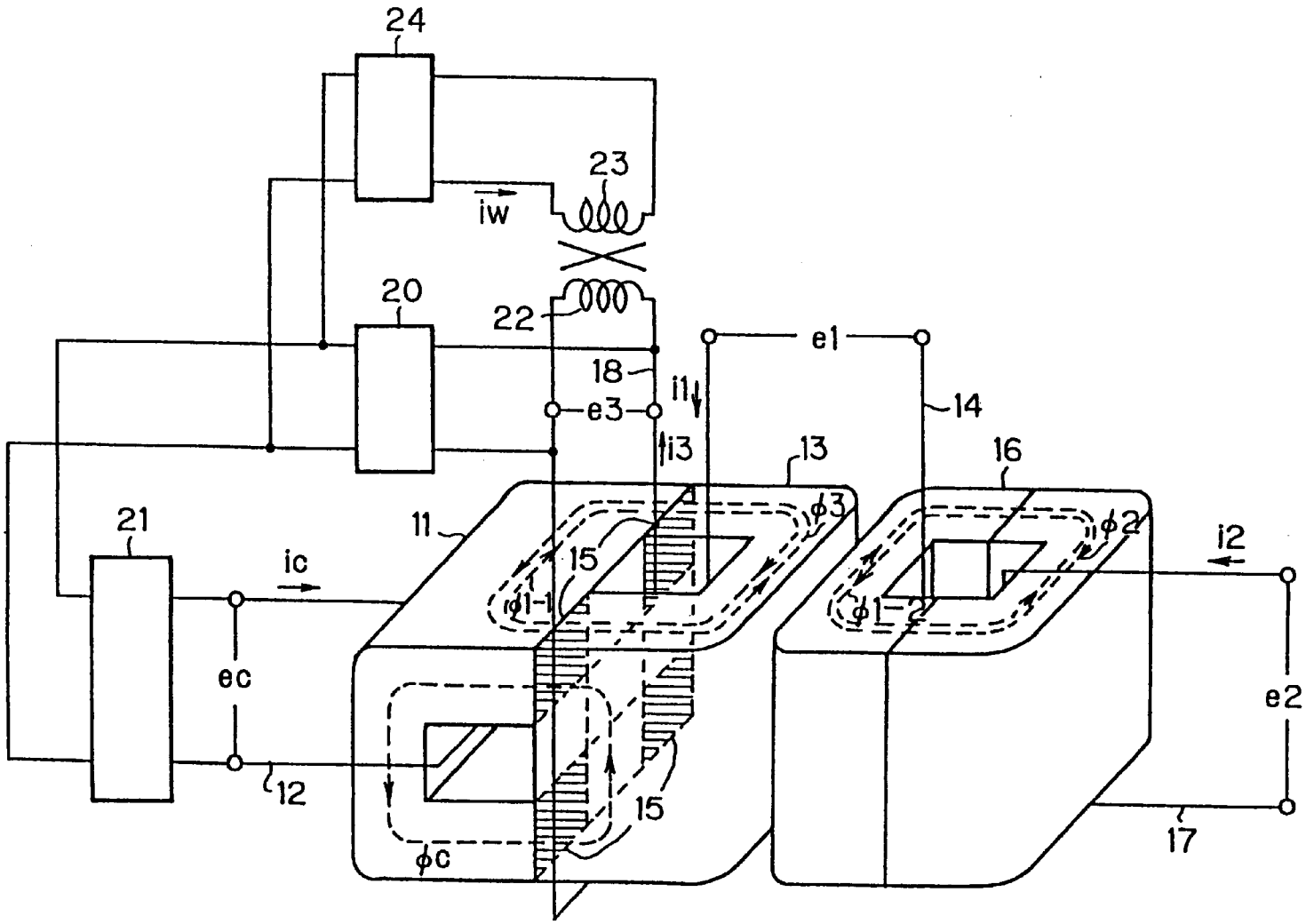
FIG. 12 is a perspective view of a control power source for a flux-controlled variable transformer for eliminating harmonics.
Figure 13:
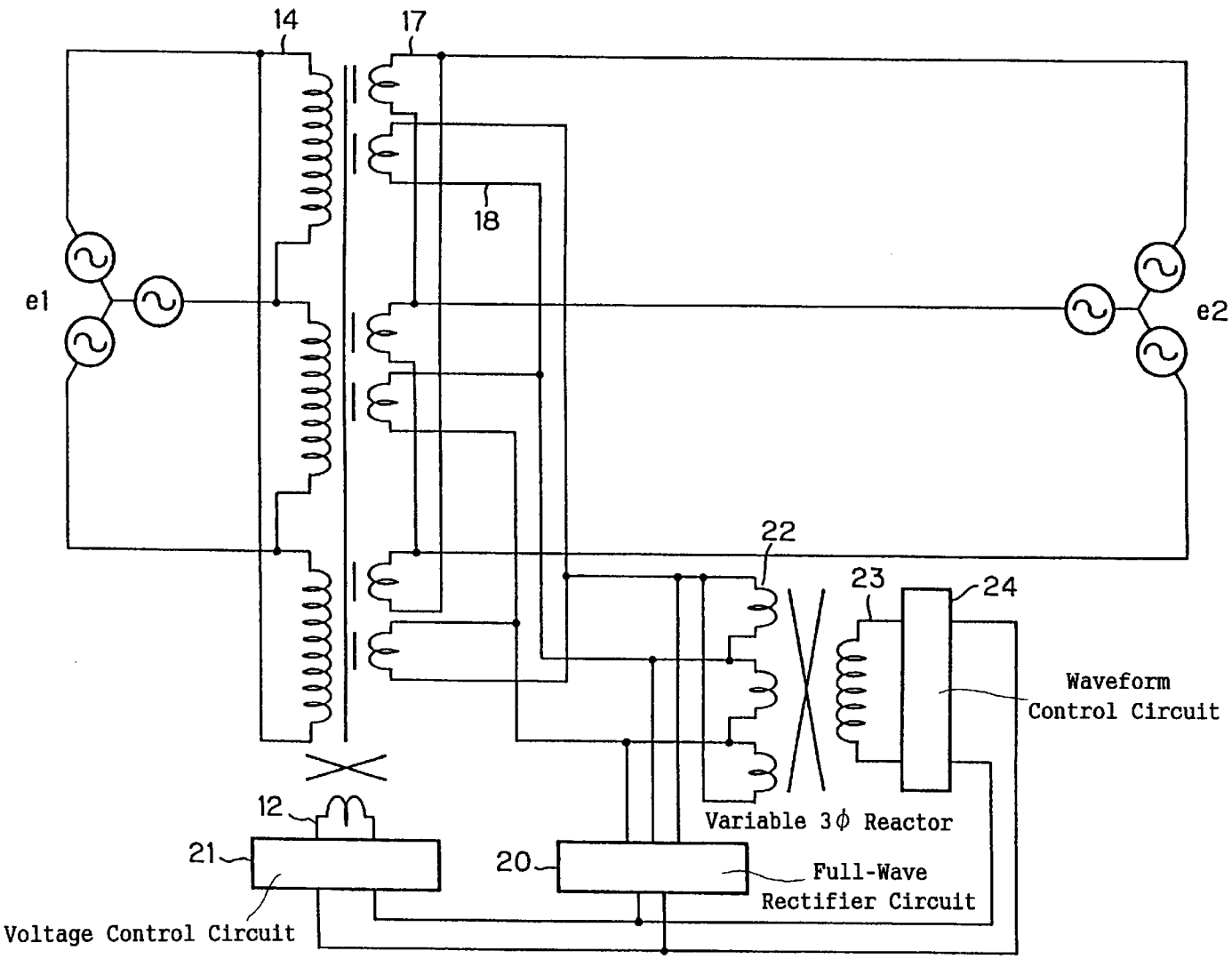
FIG. 13 is an equivalent circuit diagram of a three-phase flux-controlled variable transformer for eliminating harmonics.

FIGS. 12 and 13 show an exemplary application of a rectifier that is connected to the auxiliary winding and is used for supplying current (ic) to the control winding wound on the second cut-core. FIG. 6 shows characteristic curves of control current (ic), secondary voltage (e2) and auxiliary winding voltage (e3), plotted for a secondary winding load as parameter. These curves clearly present the correlation between the secondary winding load, the control current (ic), the secondary voltage (e2) and auxiliary winding voltage (e3). Namely, the secondary winding voltage decreases as the load increases whilst it increases as the control current (ic) increases. The auxiliary winding voltage (e3) increases as the load increases whilst it decreases as the control current (ic) increases. The auxiliary winding voltage (e3) always varies with a change in the load but can satisfy the requirement of the power supply within the range requiring the control current (ic). As shown in FIG. 6, the secondary voltage (e2) and the auxiliary winding voltage (e3) change oppositely to each other with variation of the load current (i2). The secondary voltage (e2) drops with an increase in the load, so the auxiliary winding voltage (e3) is raised to increase the control current (ic) for compensating the variation of the secondary voltage (e2).

As described above, it is possible to continuously change the secondary winding voltage (e2) by changing a value of exciting current (ic) applied to the control winding 12 wound on the second U-cut core 11 because the magnetic resistance of the first magnetic circuit of the first winding varies with change of the exciting current (ic) and causes chang of magnetic flux linking the primary secondary windings 14 and 17.

Figure 14:
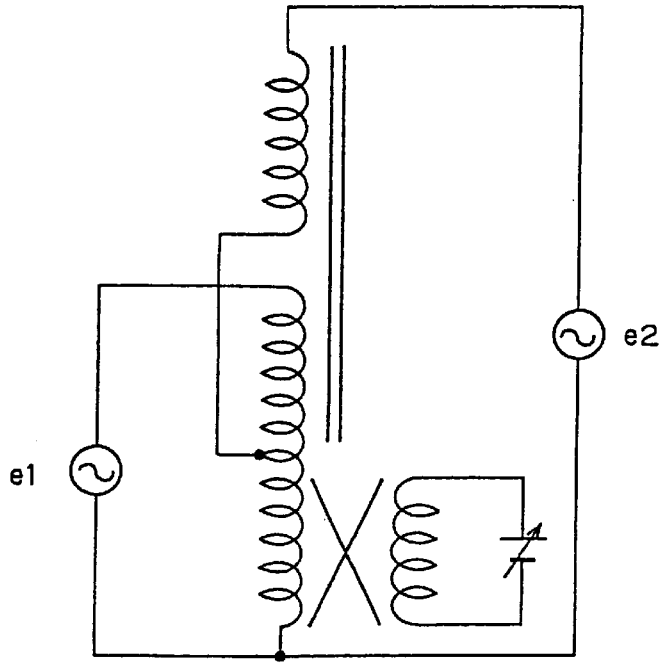
FIG. 14 is a circuit diagram of an exemplified static type voltage regulator to which a flux-controlled variable transformer of the present invention is applied.

FIG. 14 is a circuit diagram of a static type voltage regulator using a flux-controlled type variable transformer that is an embodiment of the present invention. The regulator can instantly regulate voltage since the secondary voltage (e2) is regulated by controlling magnetic flux linking the windings. The regulator has no moving contact and is free from mechanical wearing. This is a stationary device composed of copper-iron-made cores and windings, which can be applied as a voltage stabilizing apparatus for electric power system, required to satisfy high reliability for its durability, maintenance and performance.

Figure 15:
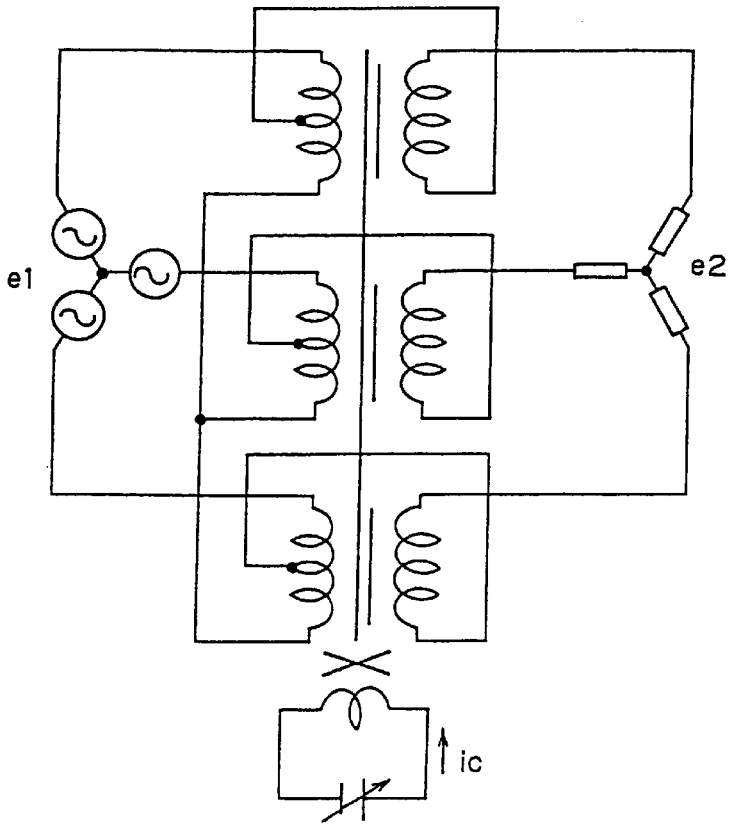
FIG. 15 is a circuit diagram of an exemplified static type voltage regulator to which a three-phase flux-controlled variable transformer of the present invention is applied.

FIG. 15 is a circuit diagram of a static type voltage regulator using a flux-controlled variable three-phase transformer that is an embodiment of the present invention.

Figure 16:
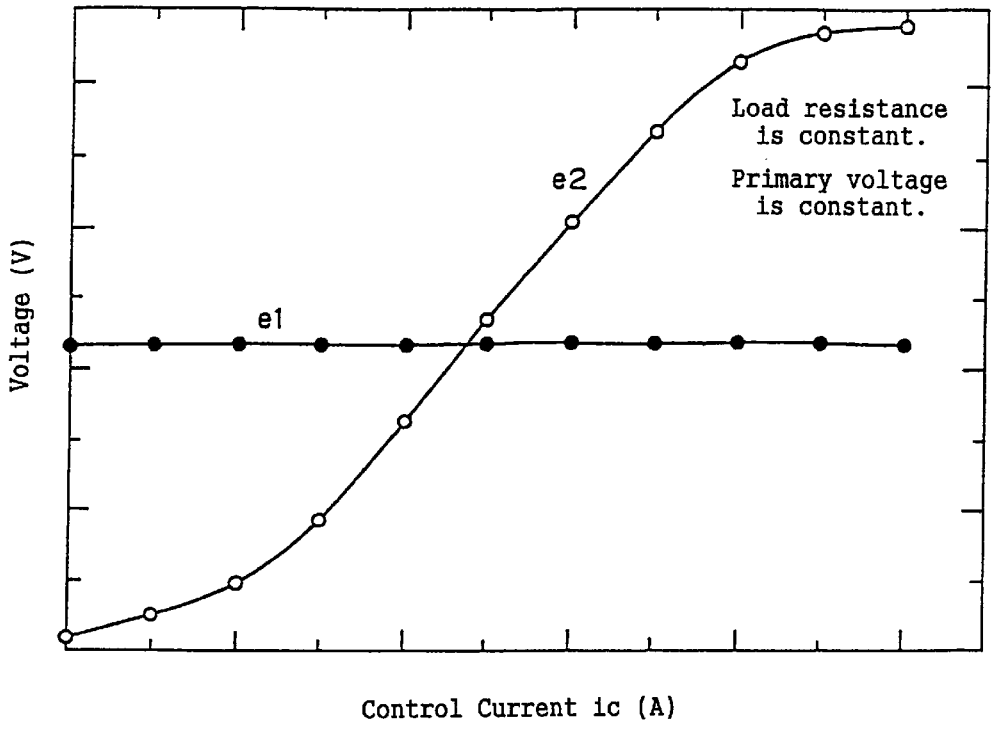
FIG. 16 shows an example of a secondary voltage control characteristic of a flux-controlled variable transformer according to the present invention.

FIG. 16 shows an exemplary secondary voltage-control characteristic of the flux-controlled type variable three-phase transformer that is used in the static type voltage regulator circuit shown in FIG. 15. It is apparent from FIG. 16 that the secondary-voltage (e2) can be continuously changed by changing control current (ic) in the control winding.

Figure 17:
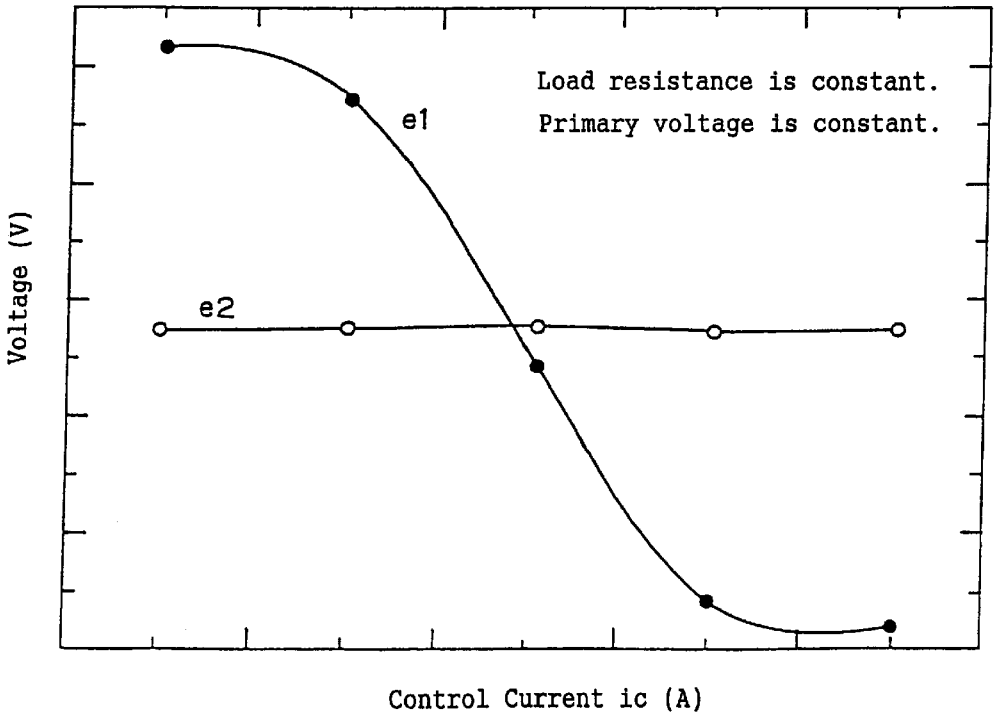
FIG. 17 shows an example of a constant voltage control characteristic of a flux-controlled variable transformer according to the present invention.
Figure 18:
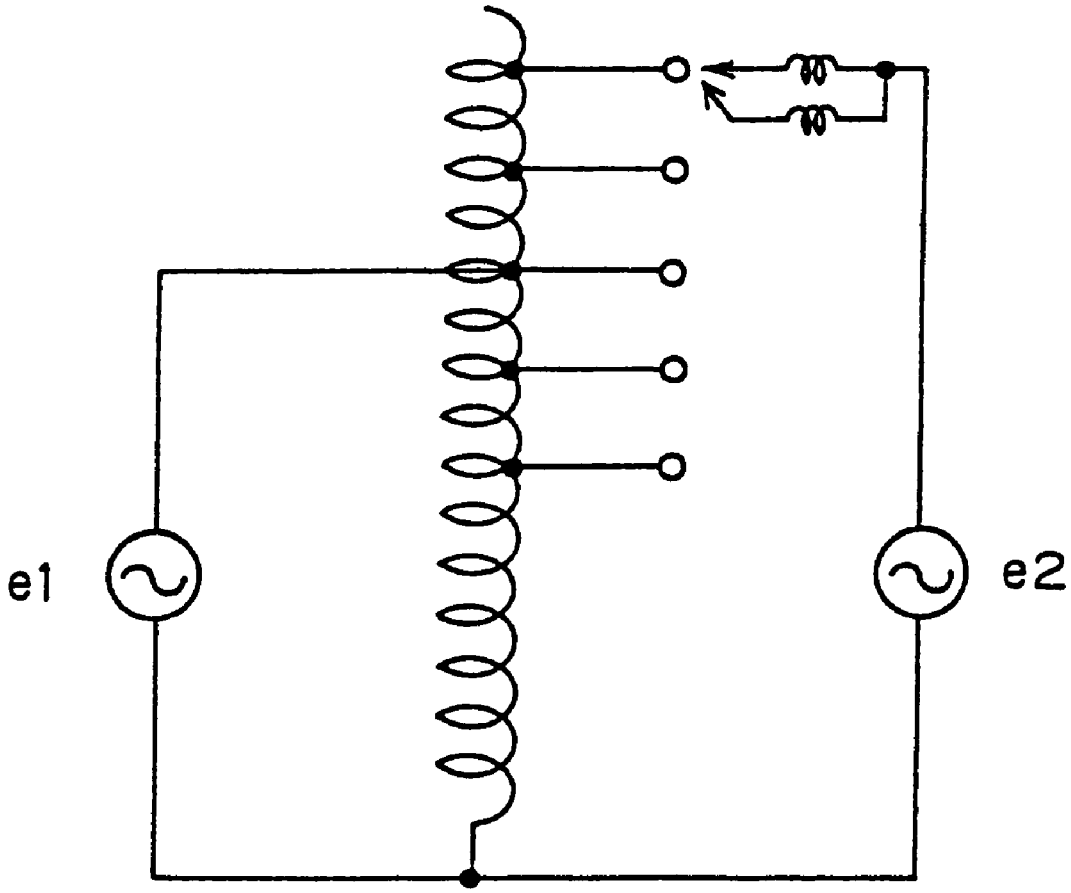
FIG. 18 is a circuit diagram of a conventional tap-changing type voltage regulator.

FIG. 17 shows an exemplary constant voltage-control characteristic of the flux-controlled type variable three-phase transformer that is used in the static type voltage regulator circuit shown in FIG. 15. The control current (ic) in the control winding 12 is used to control the secondary voltage (e2) at a constant value irrespective of variation of the primary voltage.

INDUSTRIAL APPLICABILITY

The present invention provides a flux-controlled variable transformer that can conduct high-speed regulation of voltage without using voltage-adjusting tappings. The basic circuit construction of the transformer is to control the voltage induced in the secondary winding by changing magnetic flux linking the primary and secondary windings by using variable inductance. However, it is to be understood that many changes and variations may be made without departing from the spirit and scope of the invention.

The application of the transformer of the present invention contributes stabilization of voltage in the electric power supply system and makes it possible to built up a flexible electric power equipment adaptable to variation of power system voltage due to increasing demand for electric power and a variety of loads in the recent years.

What is claimed is:

1. A flux-controlled variable transformer having a continuously variable secondary winding voltage, comprising:

a first magnetic circuit composed of a first U-cut core and a second U-cut core, both the cores contacting at their cut ends with each other in the state either of the cores having been turned by 90° in twisting direction relative to the other;

a second magnetic circuit;

a primary winding wound in common around the first U-cut core of the first magnetic circuit and the second magnetic circuit;

a secondary winding wound around the second magnetic circuit; and a control winding wound on the second U-cut core of the first magnetic circuit, wherein a secondary winding voltage can be continuously changed through control of a magnetic flux linking the primary and secondary windings with change of magnetic resistance of the first magnetic circuit having the primary winding wound thereon by changing a value of an exciting current in the control winding.

2. A flux-controlled variable transformer as defined in claim 1, wherein the first U-cut core of the first magnetic circuit has auxiliary winding wound thereon.

3. A flux-controlled variable transformer having a continuously variable secondary winding voltage, comprising:

a first three-phase magnetic circuit composed of a first three-phase E-cut core and a second U-cut core, both the cores contacting at their cut ends with each other in the state either of the cores having been turned by 90° in twisting direction relative to the other;

a second three-phase magnetic circuit;

a primary winding wound in common around the E-cut core of the first three-phase magnetic circuit and the second three-phase magnetic circuit;

a secondary winding wound around the second three-phase magnetic circuit; and a control winding wound on the second U-cut core of the first three-phase magnetic core, wherein a secondary winding voltage can be continuously changed through control of a magnetic flux linking the primary and secondary windings with change of magnetic resistance of the first three-phase magnetic circuit having the primary winding by changing a value of an exciting current in the control winding.

4. A flux-controlled variable transformer as defined in claim 3, wherein the first three-phase E-cut core of the first three-phase magnetic circuit has auxiliary winding wound thereon.

5. A flux-controlled variable transformer as defined in any one of claims 2 or 4, wherein a reactor is connected to the auxiliary winding.

6. A flux-controlled variable transformer as defined in claim 5, wherein the reactor is a variable reactor.

7. A flux-controlled variable transformer as defined in any one of claims 2, or 4, wherein the control winding is excited with current supplied from the auxiliary winding.

* * * * *

UNITED STATES PATENT AND TRADEMARK OFFICE

CERTIFICATE OF CORRECTION

PATENT NO. : 6,137,391
DATED : October 24, 2000
INVENTOR(S) : Koichi Mitamura et al.

It is certified that error appears in the above-identified patent and that said Letters Patent is hereby corrected as shown below:

Title page,
Please change, "§ 371 Date: July 19, 1999" to -- § 371 Date: March 11, 1999 --
"§ 102(e) Date: July 19, 1999" to -- § 102(e) Date: March 11, 1999 --.

Signed and Sealed this

Twenty-fifth Day of December, 2001

*Attest:*

*Attesting Officer*

JAMES E. ROGAN
*Director of the United States Patent and Trademark Office*